US006706958B1

(12) United States Patent
Mitacek

(10) Patent No.: US 6,706,958 B1
(45) Date of Patent: Mar. 16, 2004

(54) INSTRUMENT REED ENHANCEMENT DEVICE

(76) Inventor: Michael Mitacek, 178-H Casuda Canyon Dr., Monterey Park, CA (US) 91754

( * ) Notice: Subject to any disclaimer, the term of this patent is extended or adjusted under 35 U.S.C. 154(b) by 0 days.

(21) Appl. No.: 10/274,542

(22) Filed: Oct. 21, 2002

(51) Int. Cl.[7] ..... G10D 9/02
(52) U.S. Cl. ..... 84/383 A
(58) Field of Search ..... 84/383 A, 383 R, 84/385 A, 380 A, 387 R

(56) References Cited

U.S. PATENT DOCUMENTS

| | | | | |
|---|---|---|---|---|
| 2,397,593 A | | 4/1946 | Brilhart | |
| 2,494,231 A | | 1/1950 | Dunn | |
| 2,525,523 A | | 10/1950 | Chance | |
| 3,202,032 A | | 8/1965 | Strathmann | |
| 4,041,827 A | | 8/1977 | Daglis | |
| 4,337,683 A | | 7/1982 | Backus | |
| 5,127,778 A | | 7/1992 | Scheer | |
| 6,087,571 A | | 7/2000 | Legere | |
| 6,118,060 A | * | 9/2000 | Van Doren | 84/398 |

* cited by examiner

*Primary Examiner*—Kimberly Lockett
(74) *Attorney, Agent, or Firm*—Edward A. Sokolski

(57) ABSTRACT

A hard surface of an applicator which may be formed by a diamond coating is placed in abutment against the reed of a single reed instrument such as a clarinet or saxophone or a double reed instrument such as an oboe. In a single reed instrument, the applicator is held tightly against the reed by means of a ligature which fits around the mouthpiece of the instrument to hold the reed and the applicator tightly together. In a double reed instrument such as an oboe, the staple or metal tube to which the reed is attached is coated at its top with a hard surface which may be formed by a diamond coating. The reed is abutted against the diamond surface by tightly tying a string around the cane thereby firmly securing it to the staple. The constraint of the reed in this manner makes it easier to play the instrument.

6 Claims, 3 Drawing Sheets

INSTRUMENT REED ENHANCEMENT DEVICE

BACKGROUND OF THE INVENTION

1. Field of the Invention

This invention relates to musical instruments employing reeds and more particularly to a device for partially constraining a vibrating reed.

2. Description of the Related Art

In a musical instrument such as a clarinet or saxophone, it is highly desirable to control the vibration of the reed by firmly holding the reed against the mouthpiece both for enhancing the quality of the sound and facilitating the playing of the instrument. Devices have been developed in the prior art to modify the reed such as described in U.S. Pat. No. 3,759,132 issued Sep. 18, 1973 to Backus. In Backus, the reed has spaced longitudinal ribs with filler material there between. Other approaches include the placement of various shaped members between the mouthpiece of the instrument and the reed for enhancing the tone such as described in U.S. Pat. No. 4,041,827 issued Aug. 16, 1977 to Daglis and U.S. Pat. No. 3,202,032 issued Aug. 24, 1965 to Strathman.

SUMMARY OF THE INVENTION

The device of the present invention provides an improvement over the prior art by instead of modifying the reed or cane or adding a modifying insert to the mouthpiece rather utilizes a conventional reed and abuts a hard surface against such reed or cane. This partially restrains the reed or cane making it easier to play the instrument without sacrificing tonal quality.

In the device of the invention a ferrous or non-ferrous material such as stainless steel or copper has one of its surfaces coated with an abrasive material such as diamond particles or other hard abrasive substance. This coated surface is abutted against the reed or cane of the instrument by means of a ligature in the case of a reed or string in the case of a cane. The ligature or string is tightened in place to provide firm contact with the coated surface.

It is therefore an object of this invention to improve the operation of the reed or cane of a musical wind instrument.

It is a further object of this invention to facilitate the playing of a musical wind instrument employing a reed or cane.

It is still a further object of this invention to reduce the strain in long time playing of a musical wind instrument employing a reed or a cane.

Other objects of the invention will become apparent from the following description in conjunction with the accompanying drawings.

DETAILED DESCRIPTION OF THE INVENTION

Figure 1:
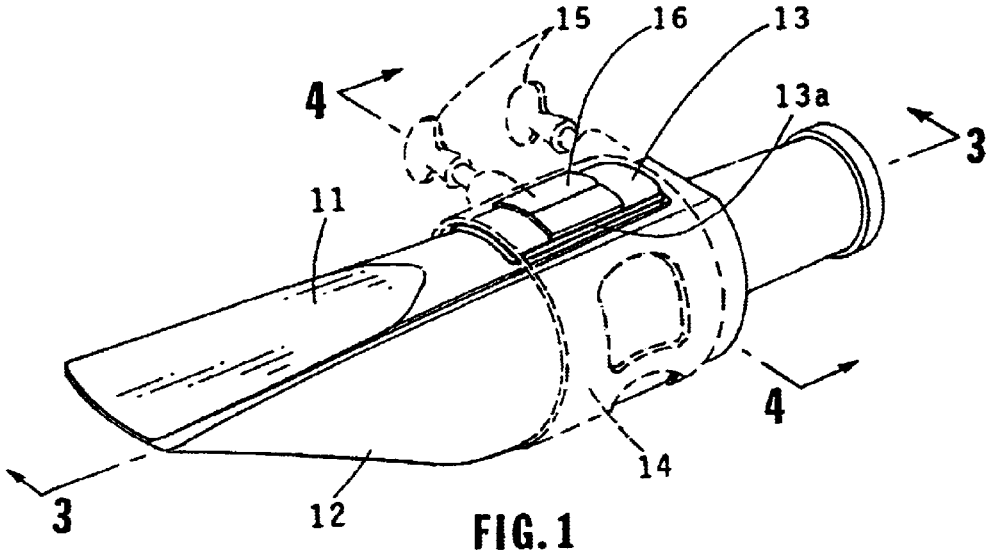
FIG. 1 is a top perspective view of a preferred embodiment of the invention.
Figure 2:
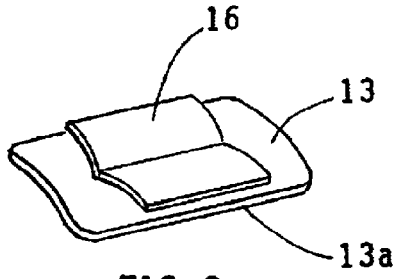
FIG. 2 is a top perspective view of the appliance of the preferred embodiment.
Figure 2A:
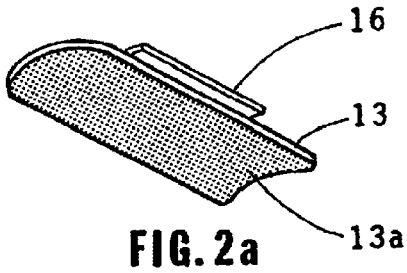
FIG. 2A is a perspective view showing the appliance turned over 180 degrees from the view in FIG. 2.
Figure 3:
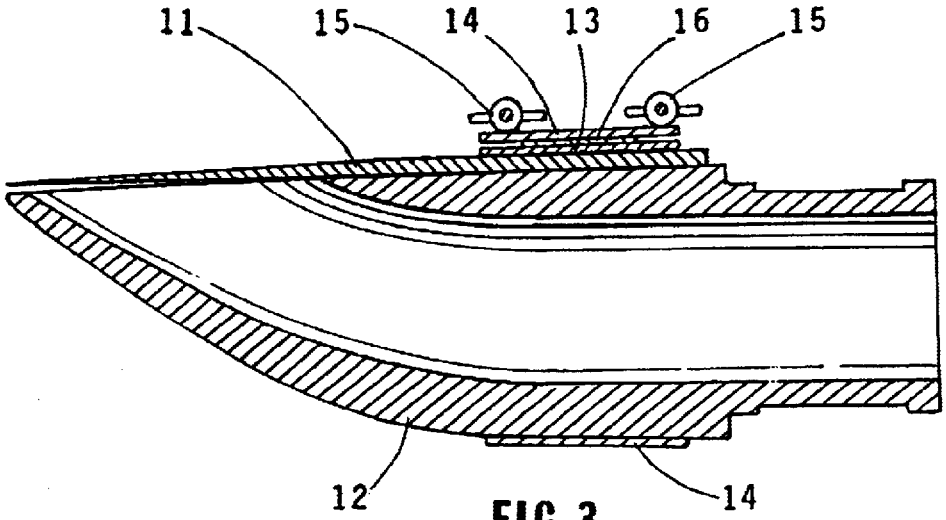
FIG. 3 is a cross sectional view taken along the plane indicated by 3—3 in FIG. 1.
Figure 4:
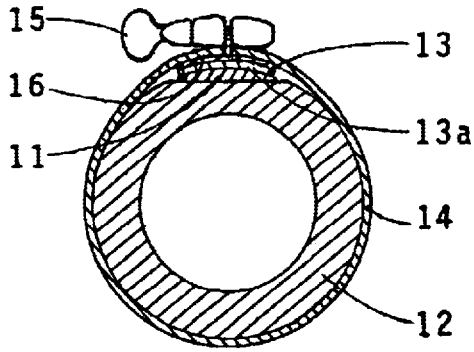
FIG. 4 is a cross sectional view taken along the plane indicated by 4—4 in FIG. 1.

Referring to the Figures, reed 11 is mounted within the mouthpiece 12 of an instrument such as a clarinet or saxophone. In abutment against the reed is an appliance 13. The appliance may be fabricated of a metal such as copper, titanium, stainless steel other ferrous or non-ferrous material, a synthetic resin or composite material. One of the surfaces 13*a* of the appliance 13 is coated with a hard abrasive material 13*a* such as diamond particles which are preferably 80–180 grit size. The diamond coated surface is slightly curved to match the curvature of he instrument. The reed is retained on the mouthpiece 11 of the instrument with the appliance held tightly in abutment there against by means of ligature 14 and pliable flexible wings 16 attached to the top surface of the appliance. The ligature is tightened in position by means of screws 15 which threadably engage the ligature.

Although diamond particles are coated on the appliance in the preferred embodiment other hard material may be employed such as gems and minerals including ruby, sapphire, emerald, agate, other precious or semi-precious gem or mineral, polyethylene or other abrasive substance or gripping material. Also man-made substances such as carbide carbonate, graphite, etc. may be used. The gripping surface 13A must be hard enough to withstand wear. To provide a long lasting gripping surface, the abrasive should be above 1860 hardness(Knoop-KG/MM2). The diamond coating is formed from industrial diamond particles which are electrolytically bonded to a conductive substrate with the particles being spaced close enough together to form a firmly gripping surface.

Figure 5:
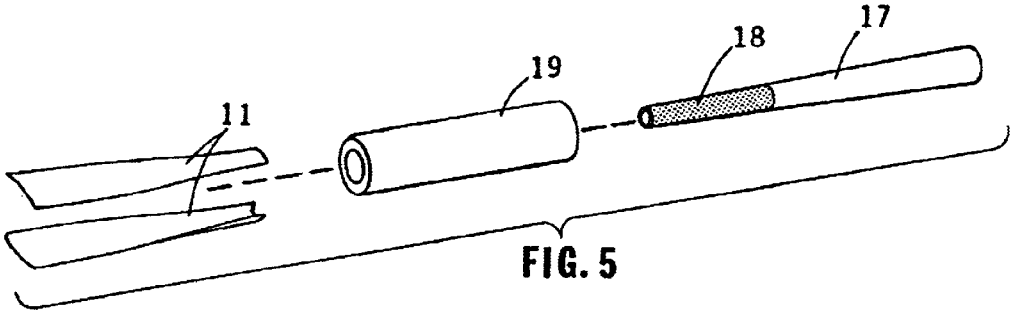
FIG. 5 is an exploded view of a second embodiment of the invention incorporated into an oboe or bassoon.
Figure 6:
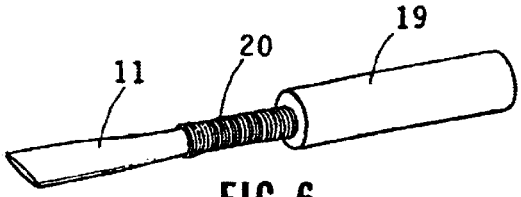
FIG. 6 is a perspective view of the second embodiment of the invention.
Figure 7:
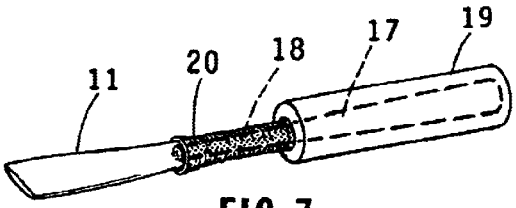
FIG. 7 is a perspective cutaway view of the second embodiment.
Figure 8:
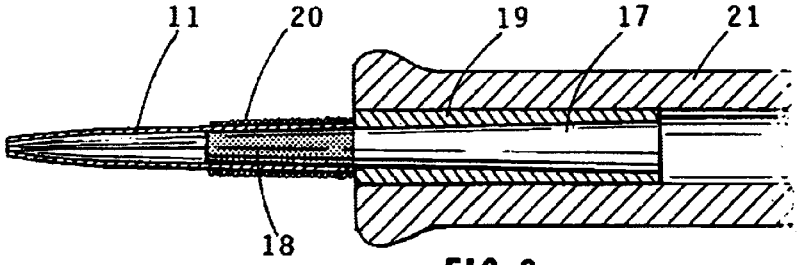
FIG. 8 is a side cross-sectional view of the second embodiment.

Referring now to FIGS. 5–8, a second embodiment of the invention installed on a wind instrument such as an oboe or bassoon is shown. Staple 17 made of a ferrous or non ferrous material such as stainless steel or copper is coated with an abrasive coating of a material such as diamond particles 18. The abrasive coated portion of the staple 18 is abutted against the cane 11 and tightly secured thereto by means of windings of string 20. The staple is retained within cork holder 19. Cork holder 19 is retained within the front portion 21 of the body of the instrument. In this manner, the device of the invention is utilized for an oboe, bassoon or similar instrument.

While the device of the invention has been described and illustrated in detail, this is intended by way of illustration and example only and not by way of limitation, the spirit and scope of the invention being limited only by the terms of the following claims.

I claim:

1. A device for enhancing the operation of a wind instrument having a mouthpiece with a reed or cane installed therein comprising:

an appliance having a hard abrasive surface;

at least a portion of said hard abrasive surface abutting against said reed or cane; and means for retaining said reed or cane and said appliance member in said mouthpiece with said hard abrasive surface abutting firmly against said reed.

2. The device of claim 1 wherein said means for firmly retaining said hard abrasive surface against said reed comprises a ligature and flexible wings attached to said appliance member against which the ligature abuts.

3. The device of claim 1 wherein said mouthpiece has a cane installed therein and said means for firmly retaining said hard surface against said cane comprises string wound tightly around said applicator member and said cane.

4. The device of claim 1 wherein said hard surface is formed from particles selected from the class consisting of diamonds, rubies, sapphires, emeralds, agate, carbide, carbonate, graphite, coral, and polyethylene.

5. The device of claim 1 wherein said hard surface is formed from diamond particles.

6. The device of claim 1 wherein hard surface is curved to match the curvature of the instrument mouthpiece.

* * * * *